US008066362B2

(12) United States Patent
Hirashima et al.

(10) Patent No.: US 8,066,362 B2
(45) Date of Patent: Nov. 29, 2011

(54) LIQUID DISCHARGING HEAD AND LIQUID DISCHARGING APPARATUS HAVING GROOVED SURFACE FROM INK INLET TO INK OUTLET

(75) Inventors: Shigeyoshi Hirashima, Kanagawa (JP); Akiko Harada, Kanagawa (JP); Shunji Yamaguchi, Kanagawa (JP)

(73) Assignee: Sony Corporation, Tokyo (JP)

( * ) Notice: Subject to any disclaimer, the term of this patent is extended or adjusted under 35 U.S.C. 154(b) by 573 days.

(21) Appl. No.: 12/075,895

(22) Filed: Mar. 14, 2008

(65) Prior Publication Data

US 2008/0239014 A1 Oct. 2, 2008

(30) Foreign Application Priority Data

Mar. 30, 2007 (JP) ..... P2007-090861

(51) Int. Cl.
*B41J 2/19* (2006.01)

(52) U.S. Cl. ..... 347/92; 347/93; 347/89

(58) Field of Classification Search ..... 347/20, 347/56, 63, 65, 67, 92–94, 84, 87, 89
See application file for complete search history.

(56) References Cited

U.S. PATENT DOCUMENTS 4,689,641 A * 8/1987 Scardovi et al. ..... 347/92

FOREIGN PATENT DOCUMENTS

| | | |
|---|---|---|
| JP | 07-117232 | 5/1995 |
| JP | 2001-287361 | 10/2001 |
| JP | 2002-144576 | * 5/2002 |
| JP | 2004-167839 | 6/2004 |
| JP | 2004-167929 | 6/2004 |
| JP | 2004-291441 | 10/2004 |
| JP | 2005-125670 | 5/2005 |

* cited by examiner

*Primary Examiner* — Juanita D Stephens
(74) *Attorney, Agent, or Firm* — Robert J. Depke; Rockey, Depke & Lyons, LLC

(57) ABSTRACT

A liquid discharging head includes a head chip including a plurality of energy generating elements configured to discharge liquid and liquid chambers provided around the corresponding energy generating elements, and a common passage member configured to define a common passage communicating with all the liquid chambers in the head chip. the liquid is discharged from the liquid chambers by driving the energy generating elements so as to apply a discharging force to the liquid. The common passage member includes an inlet through which the liquid is supplied to the common passage, and an outlet through which the liquid is ejected from the common passage. The common passage includes a ceiling surface having a groove extending from the inlet toward the outlet.

11 Claims, 8 Drawing Sheets

LIQUID DISCHARGING HEAD AND LIQUID DISCHARGING APPARATUS HAVING GROOVED SURFACE FROM INK INLET TO INK OUTLET

CROSS REFERENCES TO RELATED APPLICATIONS

The present invention contains subject matter related to Japanese Patent Application JP 2007-090861 filed in the Japanese Patent Office on Mar. 30, 2007, the entire contents of which are incorporated herein by reference.

BACKGROUND OF THE INVENTION

1. Field of the Invention

The present invention relates to a liquid discharging head and a liquid discharging apparatus which include a common passage member that defines a common passage communicating with all liquid chambers in a head chip and which discharge liquid from the liquid chambers by driving energy generating elements in the head chip so as to apply a discharging force to the liquid in the liquid chambers. More particularly, the present invention relates to a technique of smoothly removing bubbles from the liquid in the common passage.

2. Description of the Related Art

In an inkjet printer as an example of a liquid discharging apparatus, a recording sheet is conveyed to a liquid discharging head, and ink (liquid) is discharged for printing on the recording sheet by driving a heating resistor (energy generating element) in an ink chamber (liquid chamber) of a head chip that constitutes the liquid discharging head. In this inkjet printer, it is necessary to stably supply ink stored in an ink cartridge to the ink chamber of the head chip.

Water-based ink and oil-based ink can be discharged. Particularly when water-based ink is used, air dissolved in the ink sometimes form bubbles, for example, because of a temperature change, or air taken from the outside sometimes remains as bubbles in the ink. If these bubbles accumulate near the head chip, the flow of ink to the ink chamber is hindered, and sufficient ink supply is difficult during printing. For this reason, the bubbles in the ink disturb the ink discharging direction and change the ink discharging amount.

Ink is discharged by the application of a discharging force from the heating resistor in the head chip to the ink in the ink chamber. If a bubble exists in the ink, it weakens the ink discharging force because of gas compressibility, and disturbs the ink discharging direction. Further, if the bubble in the ink is expanded in accordance with the installation environment of the inkjet printer, the temperature change due to ink discharging (driving of the heating resistor), or the change in atmospheric pressure, the ink in the ink chamber is sometimes unintentionally discharged from the nozzle.

In order to overcome the above problems due to the existence of bubbles in the ink, various technologies for removing bubbles from the ink have been proposed. For example, in the case of a line printer which performs printing corresponding to the width of the recording sheet with nozzles arranged over the length corresponding to the width of the recording sheet, the number of prints is large and good durability is necessary. For this reason, bubbles near the head chip are removed from the ink by being circulated together with the ink by a transfer means such as a pump.

In this bubble removing method, bubbles can be removed with the flow of ink in the common passage communicating with all ink chambers of the head chip. That is, ink is ejected from an outlet of a buffer tank (common passage member) that defines the common passage while supplying ink from an inlet of the buffer tank, so that bubbles are removed from the common passage together with the ink.

However, in order to move bubbles, the flow velocity of ink flowing near the ink chamber of the head chip is required to be somewhat high. Therefore, in order to transfer the ink at the flow velocity, it is necessary to use a high-rate pump. Conversely, when a low-rate pump is used, the capacity of the ink chamber is reduced in order to move the bubbles by increasing the flow velocity of ink near the ink chamber. However, the number of bubbles does not vary in accordance with the capacity of the ink chamber. As the capacity of the ink chamber decreases, the influence of bubbles relatively increases.

Accordingly, in a bubble removing technique disclosed in Japanese Unexamined Patent Application Publication No. 2002-144576, a ceiling surface of a common passage defined by a buffer tank is inclined and the buoyancy of bubbles is divided by the inclination to produce a force component in the moving direction so that the bubbles can easily move even when the flow velocity of ink is relatively low.

SUMMARY OF THE INVENTION

Unfortunately, in the technique disclosed in the above-described publication, the bubbles are sometimes adsorbed on the ceiling surface of the common passage, and stay thereat. This makes it difficult to sufficiently remove the bubbles. Further, if the inclination of the ceiling surface is increased to reliably move the bubbles, the capacity of the common passage increases. As a result, the size of the pump increases.

Accordingly, it is desirable to reliably move bubbles even with a low-rate pump and to smoothly remove bubbles from liquid (ink) in a common passage.

A liquid discharging head according to an embodiment of the present invention includes a head chip including a plurality of energy generating elements configured to discharge liquid, and liquid chambers provided around the corresponding energy generating elements; and a common passage member configured to define a common passage communicating with all the liquid chambers in the head chip. The liquid is discharged from the liquid chambers by driving the energy generating elements so as to apply a discharging force to the liquid in the liquid chambers. The common passage member includes an inlet through which the liquid is supplied to the common passage, and an outlet through which the liquid is ejected from the common passage. The common passage includes a ceiling surface having a groove extending from the inlet toward the outlet.

A liquid discharging apparatus according to another embodiment of the present invention includes the above-described liquid discharging head, and transfer means configured to transfer the liquid from the inlet toward the outlet of the common passage member.

In the above embodiments, the common passage member includes the inlet through liquid is supplied to the common passage, and the outlet through which the liquid is ejected from the common passage. The ceiling surface of the common passage has the groove extending from the inlet toward the outlet. For this reason, even when bubbles contained in the liquid in the common passage are brought into contact with the ceiling surface by the buoyancy, since the ceiling surface is kept in a water retention state by the groove, it does not adsorb the bubbles. This allows the bubbles to move easily.

According to the embodiments of the present invention, since the ceiling surface of the common passage is kept in a water retention state by the groove and bubbles are not adsorbed to the ceiling surface. Therefore, bubbles contained in the liquid can easily move even when they are brought into contact with the ceiling surface by the buoyancy. For this reason, even when a low-rate pump is used, the bubbles reliably move, and can be smoothly removed from the liquid in the common passage.

DESCRIPTION OF THE PREFERRED EMBODIMENTS

An embodiment of the present invention will be described below with reference to the drawings.

In the following embodiment, a color inkjet printer (line printer 1) that discharges inks (liquids) of four colors, Y (yellow), M (magenta), C (cyan), and K (black) will be described as an example of a liquid discharging apparatus according to the present invention. A line head 10 used in the line printer 1 corresponds to the liquid discharging head in the present invention.

Figure 1:
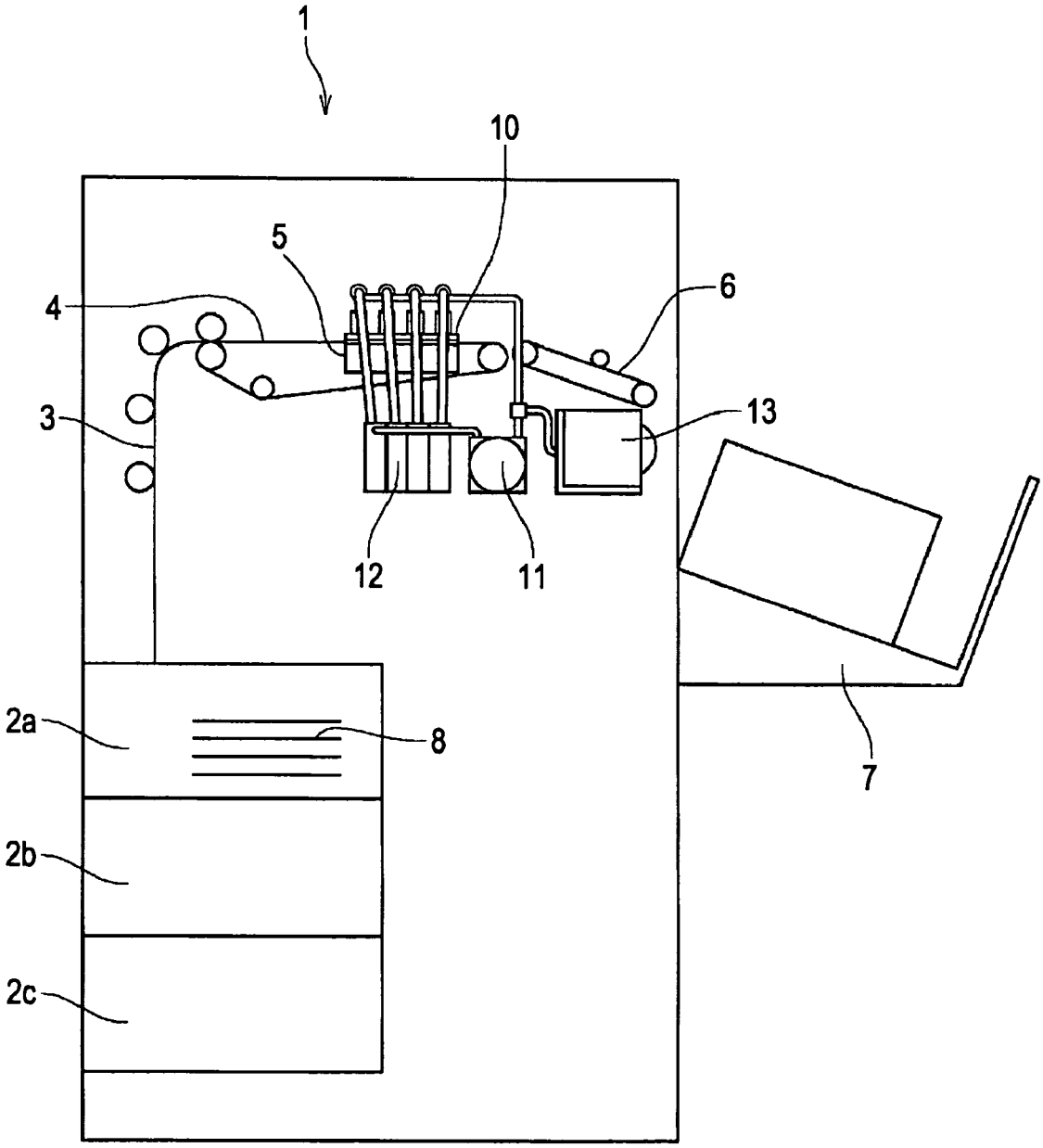
FIG. 1 is a general front view of a line printer according to an embodiment of the present invention.

FIG. 1 is a general front view of the line printer 1 according to the embodiment.

As shown in FIG. 1, the line printer 1 includes a plurality of sheet trays 2*a*, 2*b*, and 2*c*, a conveying unit 3 that conveys each recording sheet 8 selectively supplied from the sheet trays 2*a*, 2*b*, and 2*c* in accordance with the print size, a print table 4 on which the recording sheet 8 faces the line head 10, a maintenance unit 5 that covers an ink discharging surface of the line head 10 in a non-printing state, an output table 6 that conveys the recording sheet 8 after printing, and an output tray 7 for the recording sheet 8.

The line head 10 can perform printing corresponding to the width of the largest recording sheet supplied from the sheet trays 2*a*, 2*b*, and 2*c*. In contrast to a serial-head printer that performs printing by moving a serial head in the width direction of the recording sheet, the line printer 1 does not use any device for moving the line head 10. This can reduce vibration and noise, and can markedly increase the print speed.

Ink can be supplied to the line head 10 by a "head integrated method" in which ink to be supplied is provided in the head, and a "head separate method" in which ink is supplied from the outside. In this embodiment, the line printer 1 adopts a head separate method, and includes an ink cartridge 13 provided separate from the line head 10. The ink cartridge 13 separately stores four color inks Y, M, C, and K, and can be easily loaded in and unloaded from the line printer 1. For this reason, when ink in the ink cartridge 13 is completely consumed, the ink cartridge 13 can be quickly replaced with a new one.

A pump 11 (corresponding to the transfer means in the present invention) is provided between the line head 10 and the ink cartridge 13 via a subtank 12 (corresponding to the pressure adjustment unit in the present invention). By driving the pump 11, ink is supplied from the ink cartridge 13 to the line head 10 with a predetermined pressure.

In order to perform printing with this line printer 1, one recording sheet 8 is selectively conveyed from any of the sheet trays 2*a*, 2*b*, and 2*c* by the conveying unit 3, and is placed on the print table 4. The maintenance unit 5 is separated from the line head 10 so as to expose the ink discharging surface of the line head 10. Color printing is performed by discharging color inks from the line head 10 while moving the recording sheet 8 on the print table 4. After printing, the recording sheet 8 is moved by the output table 6 and is stocked in the output tray 7.

Figure 2:
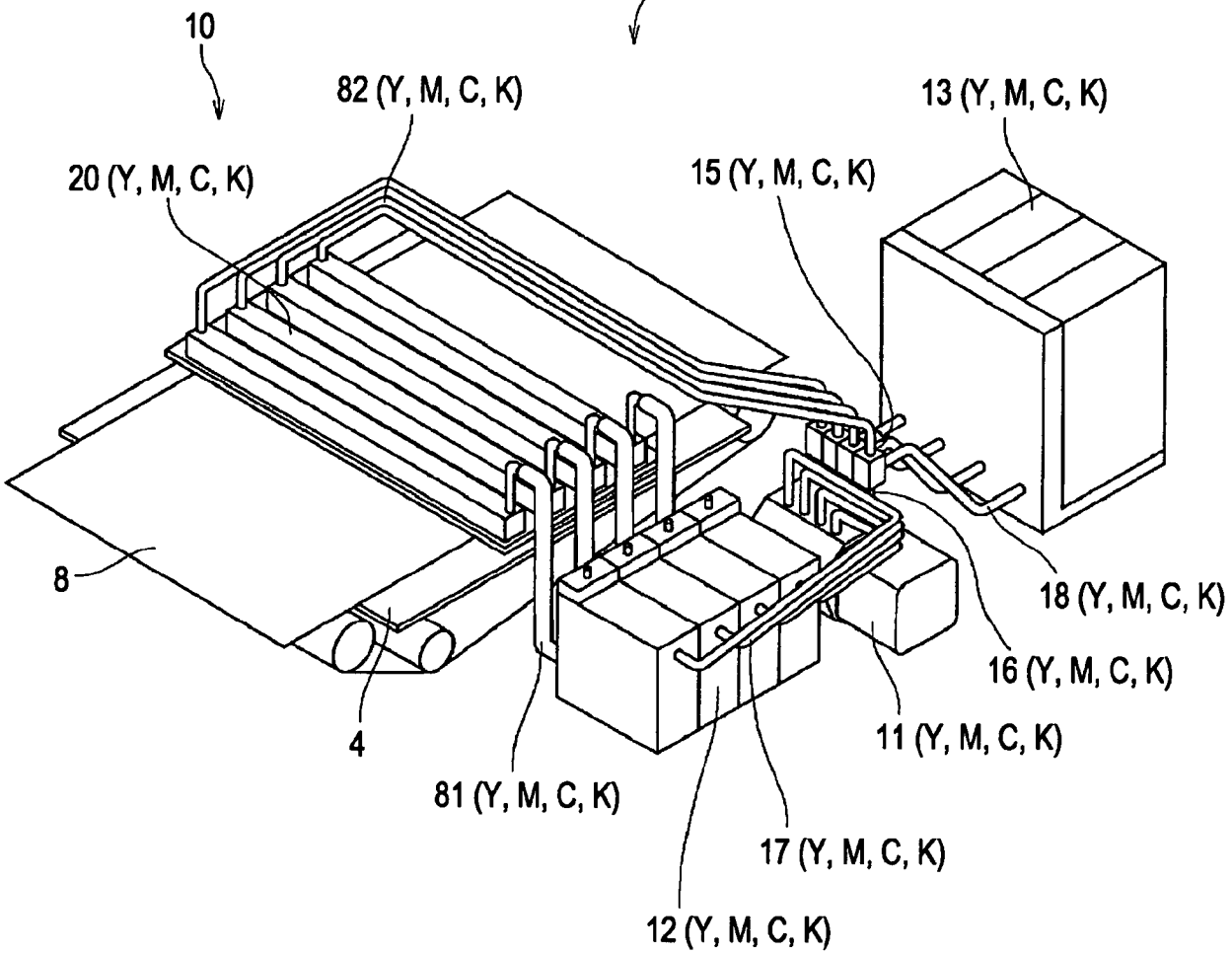
FIG. 2 is a perspective view showing a print section in the line printer.

FIG. 2 is a perspective view of a printing section in the line printer 1.

As shown in FIG. 2, a line head 10 is disposed in the print section of the line printer 1. In the line head 10, only head modules 20 cover the width of a recording sheet 8 supplied on the print table 4. Four head modules 20 are arranged in parallel so as to respectively discharge four color inks Y, M, C, and K.

In this way, the line head 10 includes the four head modules 20 (Y, M, C, and K), and four color inks Y, M, C, and K are supplied thereto from subtanks 12 that store the inks. That is, the subtanks 12 (Y, M, C, and K) are respectively connected to the head modules 20 (Y, M, C, and K) via supply tubes 81 (Y, M, C, and K). Therefore, four color inks are supplied from the subtanks 12 (Y, M, C, and K) to the line head 10 by driving the corresponding pumps 11 (Y, M, C, and K).

The four color inks supplied to the line head 10 not only are discharged onto the recording sheet 8 placed on the print table 4, but also are circulated. That is, the color inks from the line head 10 return to the subtanks 12 (Y, M, C, and K) via ejection tubes 82 (Y, M, C, and K), switch valves 15 (Y, M, C, and K), first communication tubes 16 (Y, M, C, and K), the pumps 11 (Y, M, C, and K), and second communication tubes 17 (Y, M, C, and K). Color inks consumed by discharging are replenished from the ink cartridges 13 (Y, M, C, and K) to the subtanks 12 (Y, M, C, and K) via connecting tubes 18 (Y, M, C, and K), the switch valves 15 (Y, M, C, and K), the first communication tubes 16 (Y, M, C, and K), the pumps 11 (Y, M, C, and K), and the second communication tubes 17 (Y, M, C, and K).

Figure 3:
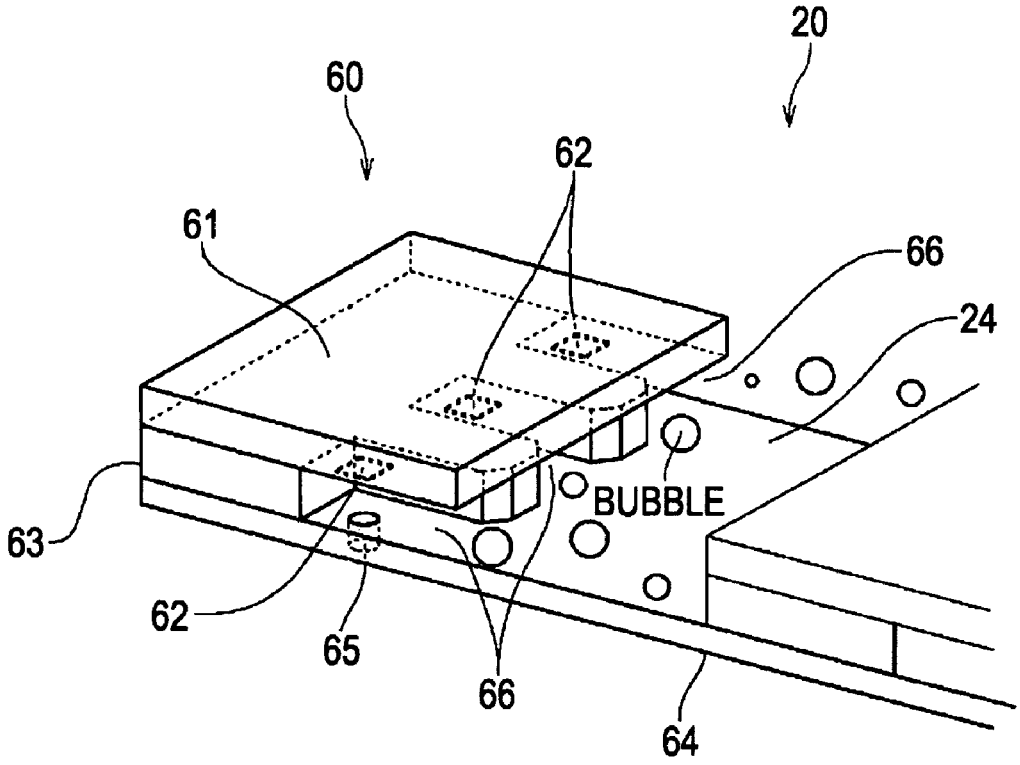
FIG. 3 is a perspective view of an ink discharging section of a head module in a line head of the line printer.

FIG. 3 is a perspective view of an ink discharging section of the head module 20 provided in the line head 10 of the line printer 1.

As shown in FIG. 3, the head module 20 is formed by bonding a head chip 60 and a nozzle sheet 64 together.

In the head chip 60, a barrier layer 63 is stacked on a semiconductor substrate 61, and the nozzle sheet 64 having nozzles 65 is bonded to the barrier layer 63. A plurality of heating resistors 62 (corresponding to the energy generating element in the present invention) are deposited at regular intervals in one direction on the semiconductor substrate 61. The semiconductor substrate 61, the barrier layer 63, and the nozzle sheet 64 surround the heating resistors 62 so as to define ink chambers 66 (corresponding to the liquid chamber in the present invention). The ink chambers 66 respectively have apertures communicating with a common ink passage 24. Ink is supplied to the ink chambers 66 through the apertures.

The semiconductor substrate 61 is formed of, for example, silicone, glass, or ceramics. The heating resistors 62 are deposited on one surface of the semiconductor substrate 61 by a micro fabrication technology for fabricating semiconductors and electronic devices. The heating resistors 62 are electrically connected to an external circuit via a conductor portion (not shown) provided on the semiconductor substrate 61.

The barrier layer 63 is provided on the surface of the semiconductor substrate 61 having the heating resistors 62. That is, the barrier layer 63 is patterned on a portion of the semiconductor substrate 61 excluding the vicinities of the heating resistors 62 in the following manner. First, photosensitive resin is applied on the entire upper surface of the semiconductor substrate 61, and is exposed via a photomask having a predetermined pattern by an exposure apparatus using light having the best wavelength band for exposure. The exposed photosensitive resin is then developed with a predetermined developing liquid, and an unexposed portion is removed. The semiconductor substrate 61, the heating resistors 62, and the barrier layer 63 constitute the head chip 60.

The nozzle sheet 64 is formed by, for example, electroforming using Ni (nickel). A plurality of nozzles 65 are arranged in the nozzle sheet 64. The head chip 60 (the semiconductor substrate 61, the heating resistors 62, and the barrier layer 63) is precisely positioned so that the nozzles 65 are aligned with the heating resistors 62, that is, so that the nozzles 65 oppose the heating resistors 62. Further, the head chip 60 is bonded onto the nozzle sheet 64 with the barrier layer 63 facing downward.

Therefore, the ink chambers 66 of the head chip 60 are defined by the semiconductor substrate 61, the barrier layer 63, and the nozzle sheet 64 so as to surround the heating resistors 62, as shown in FIG. 3. That is, the semiconductor substrate 61 and the heating resistors 62 form top walls of the ink chambers 66, the barrier layer 63 forms three side walls of each ink chamber 66, and the nozzle sheet 64 forms bottom walls of the ink chambers 66.

The ink chambers 66 respectively have apertures on the lower right side in FIG. 3, and the apertures communicate with the ink common passage 24. For this reason, ink supplied from the subtank 12 (see FIG. 2) is supplied into all the ink chambers 66 via the common passage 24. When a short pulse current (for example, 1 to 3 μsec) is passed through any of the heating resistor 62 according to a command from a control unit (not shown) in a state in which the corresponding ink chamber 66 is filled with ink, the heating resistor 62 is heated rapidly. Then, the ink boils and a bubble is produced in a contact portion between the ink and the heating resistor 62, and a certain volume of ink is pushed away by expansion of the bubble. This pushing force serves as a discharging force, and ink having a volume equivalent to the volume of the pushed ink is discharged in the form of an ink droplet from the nozzle 65, thus performing printing.

If there is a bubble in the ink chamber 66, as shown in FIG. 3, the bubble weakens the ink discharging force because of gas compressibility, and disturbs the ink discharging direction. Further, if the bubble in the ink is expanded by a temperature change due to ink discharging (heating of the heating resistor 62), the ink in the ink chamber 66 is sometimes unintentionally discharged from the nozzle 65. For this reason, the head module 20 not only supplies ink to the ink chambers 66 of the head chip 60 and discharges the ink from the nozzles 65, and also removes ink containing bubbles from the common passage 24.

Figure 4:
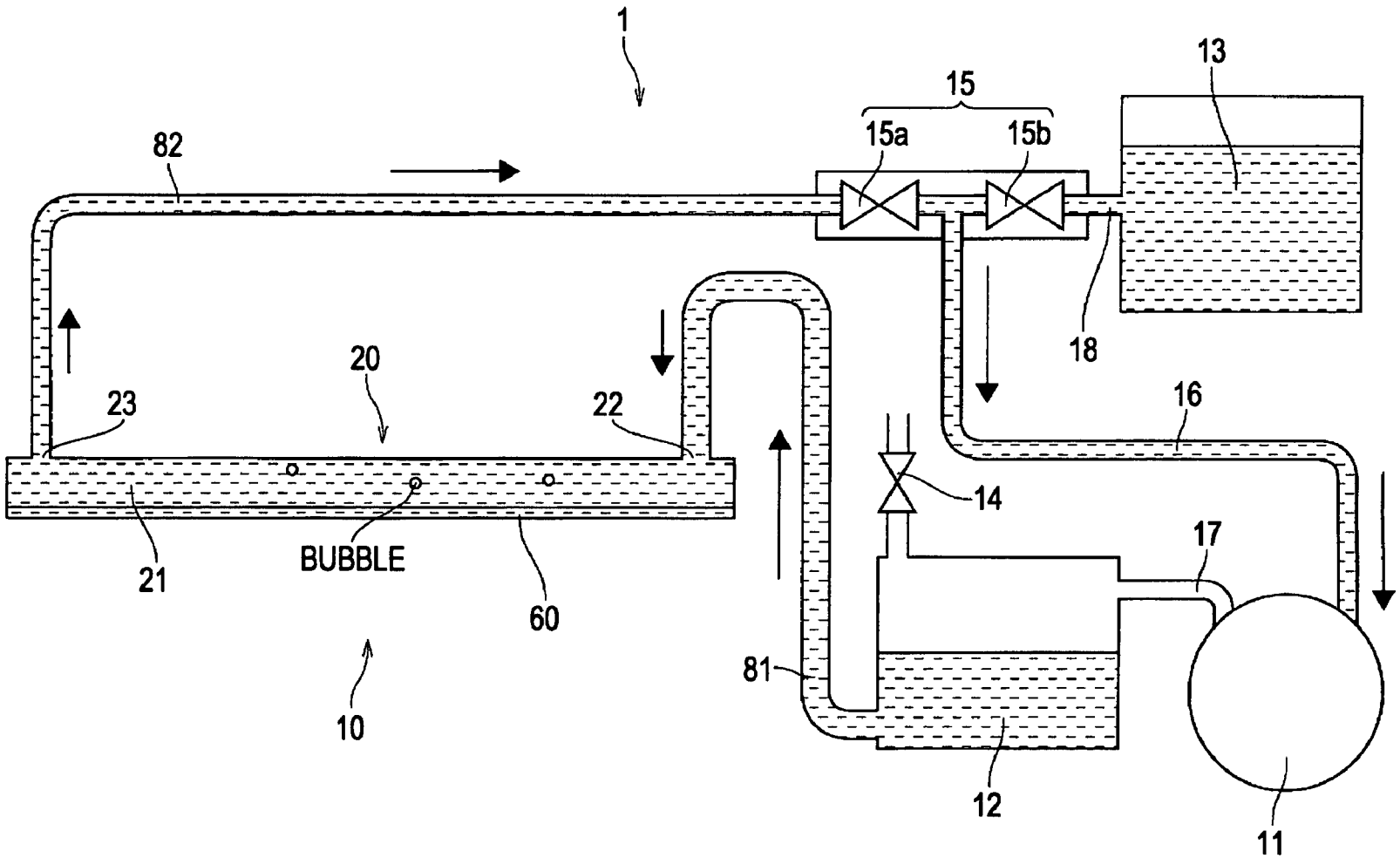
FIG. 4 is a conceptual view of the line printer.

FIG. 4 is a conceptual view showing the line printer 1 according to this embodiment in which bubbles can be removed from the ink.

As shown in FIG. 4, the line printer 1 includes a line head 10 having a head module 20, a pump 11 that transfers ink, a subtank 12 that adjusts the pressure of ink to be supplied to the line head 10, and an ink cartridge 13 that stores the ink to be supplied to the line head 10.

The head module 20 includes a head chip 60 and a buffer tank 21 (corresponding to the common passage member in the present invention) for discharging ink. Unlike the structure shown in FIG. 2 in which the four head modules 20 (Y, M, C, and K) are arranged, the line head 10 shown in FIG. 4 discharges ink of one color. However, the basic operation of the line head 10 does not change even when the number of ink colors increases.

The buffer tank 21 forms a common passage 24 (see FIG. 3) communicating with all ink chambers 66 (see FIG. 3) in the head chip 60. The buffer tank 21 includes an inlet 22 through which ink is supplied to the inside, and an outlet 23 through which the ink is discharged from the inside.

The inlet 22 of the buffer tank 21 is connected to a supply tube 81 through which ink in the subtank 12 is supplied to the buffer tank 21. The outlet 23 of the buffer tank 21 is connected to an ejection tube 82 through which the ink is ejected from the buffer tank 21. The ejection tube 82 is connected to the pump 11 via a circulation-side section 15*a* of a switch valve 15 and a first communication tube 16, and the pump 11 is connected to the subtank 12 via a second communication tube 17. The subtank 12 is provided with a communication valve 14 that allows the interior of the subtank 12 to communicate with the atmosphere. A supply-side section 15*b* of the switch valve 15 is connected to a connecting tube 18 that supplies ink stored in the ink cartridge 13.

In order to supply ink from the subtank 12 to the buffer tank 21 in the line printer 1, the supply-side section 15*b* of the switch valve 15 is closed and the circulation-side section 15*a* is opened, as shown in FIG. 4. Subsequently, the communication valve 14 is closed. These operations may be performed simultaneously or in different orders.

When the pump 11 is driven in this state, air in the buffer tank 21 and air from nozzles 65 (see FIG. 3) of the head chip 60 are transferred via the ejection tube 82, the circulation-side section 15*a* of the switch valve 15, the first communication tube 16, the pump 11, and the second communication tube 17, and are accumulated in the subtank 12. For this reason, the pressure in the subtank 12 increases above the atmospheric pressure. Then, the ink passes through the supply tube 81, and is supplied to the buffer tank 21.

When the ink is supplied to the buffer tank 21 in this way, the nozzles 65 of the head chip 60 are closed by the ink, and no more air enters the nozzles 65. For this reason, the pressure in the subtank 12 does not increase further, but is in equilibrium. Since ink supply from the subtank 12 to the buffer tank 21 is thereby completed, the head chip 60 is allowed to discharge ink.

In order to perform printing by discharging ink from the head chip 60, the circulation-side section 15*a* of the switch valve 15 is closed, the supply-side section 15*b* is opened, and the communication valve 14 is opened. By driving heating resistors 62 (see FIG. 3) in the head chip 60 in this state, a discharging force is applied to the ink in the ink chambers 66, and the ink is discharged from the ink chambers 66 through the nozzles 65.

When the subtank 12 runs short of ink because of ink discharging from the head chip 60, ink can be added to the subtank 12 by driving the pump 11 while exerting little influence on ink discharging of the head chip 60. That is, ink in the ink cartridge 13 is supplied into the subtank 12 via the connecting tube 18, the supply-side section 15*b* of the switch valve 15, the first communication tube 16, the pump 11, and the second communication tube 17 by driving the pump 11.

An ink-amount measuring device (not shown) is attached to the subtank 12, and outputs an ink-amount limit signal when the level of ink in the subtank 12 reaches a predetermined ink level. When the control unit (not shown) receives this limit signal, it issues a command to the pump 11. According to the command, the pump 11 automatically stops, and the addition of ink to the subtank 12 is completed. This ink supply to the subtank 12 is also automatically performed when the subtank 12 is empty of ink, for example, when the line printer 1 is first started.

Therefore, a predetermined amount of ink is constantly stored in the subtank 12, and the ink is stably supplied to the head module 20. This allows the line printer 1 to achieve high-quality printing. In order to maintain the high quality, it is necessary to sufficiently remove bubbles from the ink.

In the line printer 1, bubbles are removed from the ink by circulating the ink. For that purpose, the circulation-side section 15*a* of the switch valve 15 is opened, the supply-side section 15*b* is closed, and the communication valve 14 is opened. By opening the communication valve 14, the entire ink circulation path is brought into a state in which the pressure is fixed in accordance with the ink level in the subtank 12.

When the pump 11 is driven in this state, the ink is supplied from the subtank 12 to the common passage 24 (see FIG. 3) of the buffer tank 21 via the supply tube 81 and the inlet 22, as shown by the arrows in FIG. 4. Then, ink containing bubbles in the buffer tank 21 is transferred in accordance with the supply pressure, and is ejected from the outlet 23. The ejected ink returns to the subtank 12 via the ejection tube 82, the circulation-side section 15*a* of the switch valve 15, the first communication tube 16, the pump 11, and the second communication tube 17. In the subtank 12, bubbles are removed from the ink by being released into the atmosphere.

In the line printer 1, ink containing bubbles is thus circulated by driving the pump 11, as shown by the arrows in FIG. 4, and the bubbles are thereby removed from the buffer tank 21. However, if the bubbles touch and are adsorbed to the ceiling surface of the common passage 24 in the buffer tank 21, they are hindered from moving and being removed. For this reason, the line head 10 has a structure that allows bubbles to easily move on the ceiling surface of the common passage 24.

First Embodiment

Figure 5A:
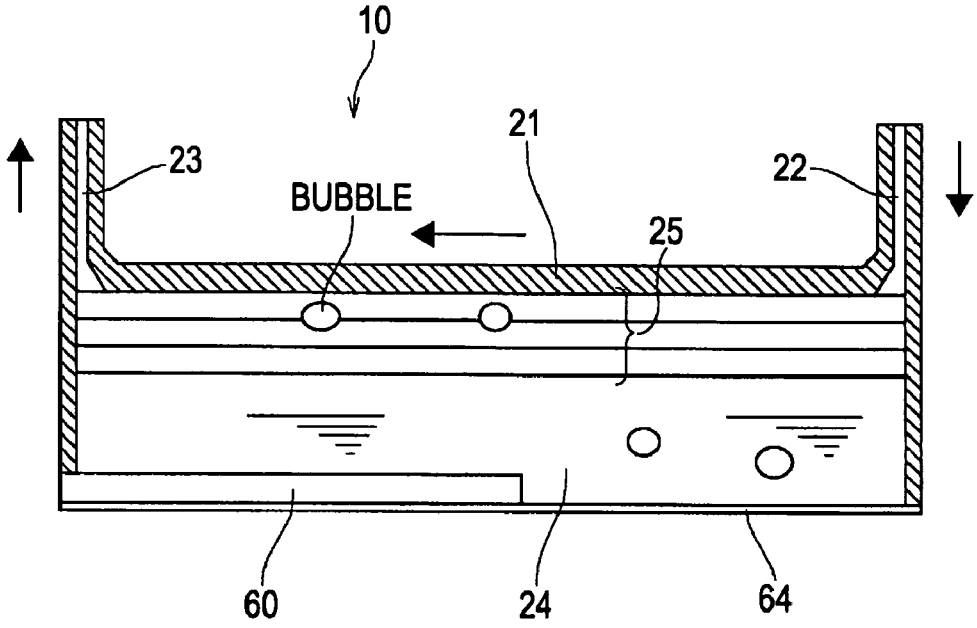
FIG. 5 is a cross-sectional view of a line head according to a first embodiment.
Figure 5B:
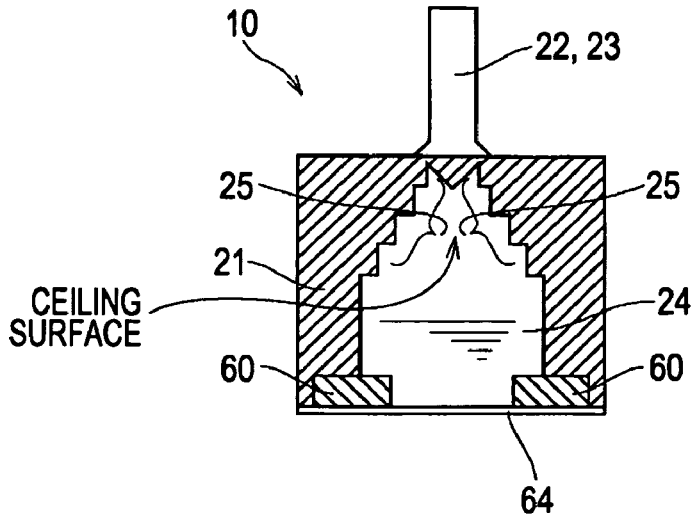

FIGS. 5A and 5B are cross-sectional views of the line head 10*s* shown in FIG. 4 according to a first embodiment.

As shown in FIGS. 5A and 5B, the line head 10 includes a head chip 60, a nozzle sheet 64, and a buffer tank 21. A common passage 24 is defined by the buffer tank 21. Ink is supplied into the common passage 24 through an inlet 22, and ink containing bubbles is ejected through an outlet 23. A ceiling surface of the common passage 24 has a plurality of (four on each of the right and left sides) grooves 25 extending from the inlet 22 toward the outlet 23.

Bubbles produced in the common passage 24 rise because of buoyancy. Although the bubbles are going to stick on the ceiling surface of the common passage 24, the ceiling surface has a plurality of grooves 25, and ink is retained in the grooves 25 by capillary action. For this reason, even if the bubbles attempt to stick on the ceiling surface of the common passage 24, the sticking force of the bubbles is seriously reduced, because the ink retained in the grooves 25 lies between the bubbles and the ceiling surface.

The grooves 25 are provided to form steps, and a down-pointing triangular portion at the top is provided between the grooves 25. Therefore, even when the bubbles touch the ceiling surface of the common passage 24 near the grooves 25, they touch only edges of the grooves 25. Therefore, the contact areas between the bubbles and the grooves 25 are small, and this reduces the sticking force. As a result, bubbles in the ink in the common passage 24 easily move not only in the upward direction, but also in the right-left direction.

When ink is circulated so that ink is supplied to this common passage 24 from the inlet 22 and is ejected from the outlet 23, bubbles move toward the outlet 23 with the flow of the ink even when the flow velocity of the ink is low, since the sticking force of the bubbles to the ceiling surface of the common passage 24 is small. Finally, the bubbles are ejected together with the ink from the outlet 23. The bubbles in the ejected ink are removed at the subtank 12 (see FIG. 4).

Second Embodiment

Figure 6:
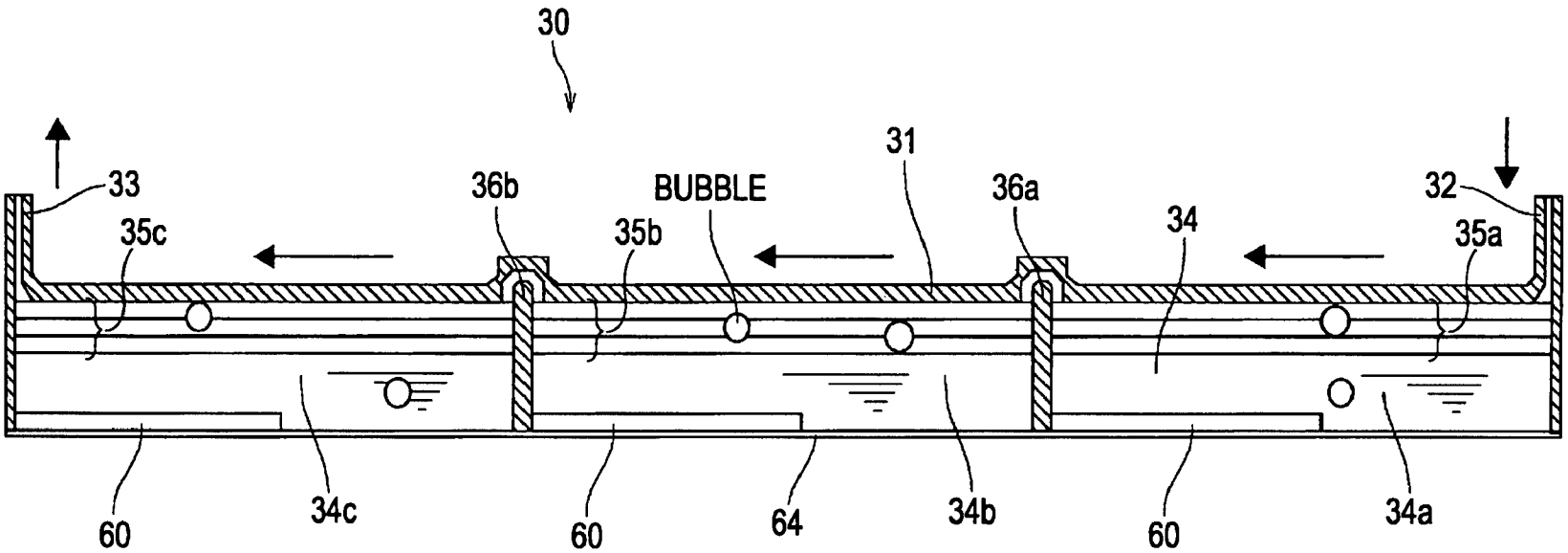
FIG. 6 is a cross-sectional view of a line head according to a second embodiment.

FIG. 6 is a cross-sectional view of a line head 30 according to a second embodiment.

As shown in FIG. 6, a buffer tank 31 in the line head 30 according to the second embodiment includes two partition walls 36*a* and 36*b*. By the two partition walls 36*a* and 36*b*, a common passage 34 is divided into three passage chambers 34*a*, 34*b*, and 34*c* between an inlet 32 and an outlet 33. The passage chambers 34*a*, 34*b*, and 34*c* communicate with one another on the upper sides of the partition walls 36*a* and 36*b*. A head chip 60 is provided in each of the three passage chambers 34*a*, 34*b*, and 34*c*.

On ceiling surfaces of the passage chambers 34*a*, 34*b*, and 34*c* of the common passage 34, a plurality of grooves 35*a*, 35*b*, and 35*c* extend from the inlet 32 toward the outlet 33. For this reason, when ink is supplied (circulated) from the inlet 32, a bubble in the passage chamber 34*a* moves along the groove 35*a* with the flow of the ink, and enters the next passage chamber 34 beyond the partition wall 36*a*. Thus, the bubble is removed from the ink in the passage chamber 34*a*.

The bubble entering the passage chamber 34*b* does not sink down, but moves along the groove 35*b*. Then, the bubble is combined with a bubble originally existing in the passage chamber 34*b* into a larger bubble, and enters the next passage chamber 34*c* beyond the partition wall 36*b*. For this reason, the bubble is also removed from the ink in the passage chamber 34*b*.

Further, the bubble entering the passage chamber 34*c* is combined with a bubble originally existing in the passage chamber 34*c* into an even larger bubble, and moves along the groove 35*c*. The bubble is then ejected together with the ink from the outlet 33. As a result, bubbles are ejected from all the passage chambers 34*a*, 34*b*, and 34*c*, and are removed at a subtank 12 (see FIG. 4). Since bubbles can be similarly removed, regardless of the number of passage chambers in the common passage 34, the line head 30 of the second embodiment is effective particularly when it includes a lot of head chips 60.

Third Embodiment

Figure 7:
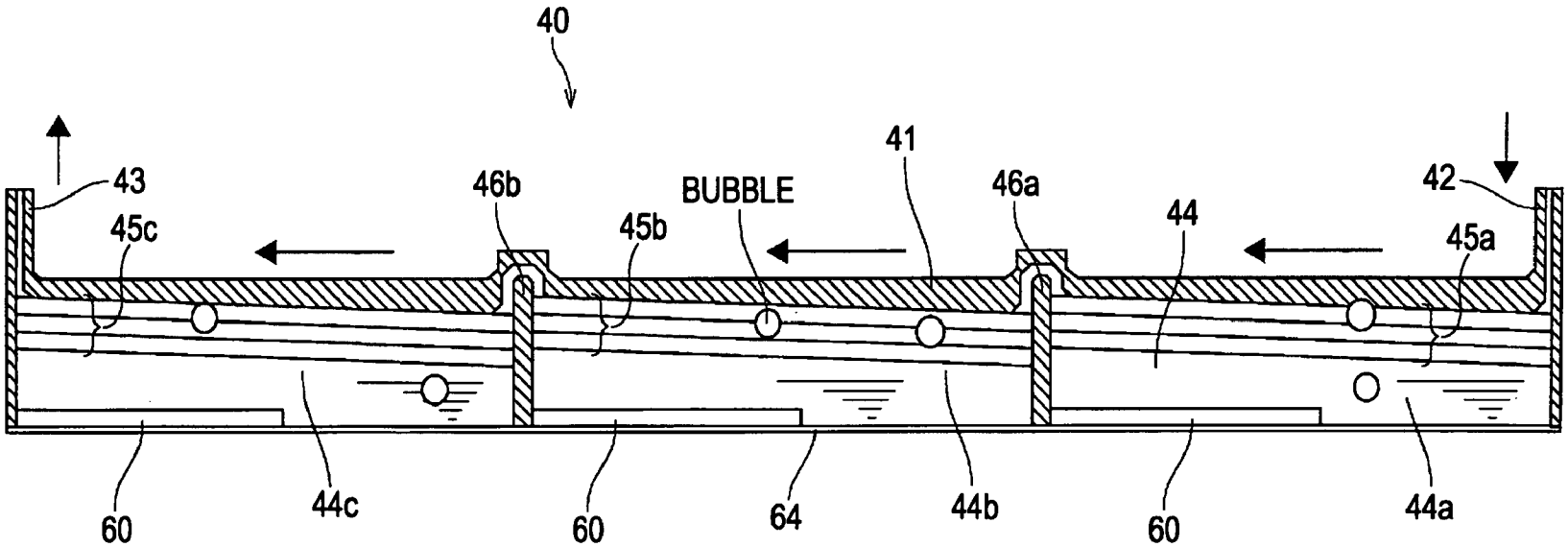
FIG. 7 is a cross-sectional view of a line head according to a third embodiment.

FIG. 7 is a cross-sectional view of a line head 40 according to a third embodiment of the present invention.

As shown in FIG. 7, a buffer tank 41 in the line head 40 according to the third embodiment includes two partition walls 46*a* and 46*b*, similarly to the line head 30 of the second embodiment shown in FIG. 6. By the two partition walls 46*a* and 46*b*, a common passage 44 is divided into three passage chambers 44*a*, 44*b*, and 44*c* between an inlet 42 and an outlet 43. The passage chambers 4*a*, 44*b*, and 44*c* communicate with one another on the upper sides of the partition walls 46*a* and 46*b*.

On ceiling surfaces of the passage chambers 44*a*, 44*b*, and 44*c* of the common passage 44, a plurality of grooves 45*a*, 45*b*, and 45*c* extend from the inlet 42 toward the outlet 43. The grooves 45*a*, 45*b*, and 45*c* are similarly inclined upward from the inlet 42 toward the outlet 43.

In the line head 40, the grooves 45*a*, 45*b*, and 45*c* are thus inclined upward from the inlet 42 toward the outlet 42, and the entrance side of each of the passage chambers 45*a*, 45*b*, and 45*c* is lower than the exit side thereof. For this reason, even when bubbles rise because of buoyancy and touch the grooves 45*a*, 45*b*, and 45*c*, the buoyancy is divided by the inclination of the grooves 45*a*, 45*b*, and 45*c*. Consequently, a force component heading from the entrance side of each of the passage chambers 44*a*, 44*b*, and 44*c* toward the exit side is produced.

While the bubbles can easily move by the effect of the grooves 45*a*, 45*b*, and 45*c*, they are even more easily ejected from the passage chambers 44*a*, 44*b*, and 44*c* not only by the circulation of ink, but also by the force components produced by the inclinations of the grooves 45*a*, 45*b*, and 45*c*. Even when the line printer 1 is inclined, for example, because of the installation condition, bubbles can be easily ejected as long as the inclination is within the height difference between both ends of each of the grooves 45*a*, 45*b*, and 45*c*.

Alternatively, an inclined groove may extend through the entire common passage 44, instead of forming a groove in each of the passage chambers 44*a*, 44*b*, and 44*c*. However, when the grooves 45*a*, 45*b*, and 45*c* are inclined, as in the line head 40 of the third embodiment, a height difference can be formed between the entrance side and the exit side of each of the passage chambers 44*a*, 44*b*, and 44*c*. This provides a high ratio of the length and the height difference, and increases the force component produced by the inclination.

Fourth Embodiment

Figure 8:
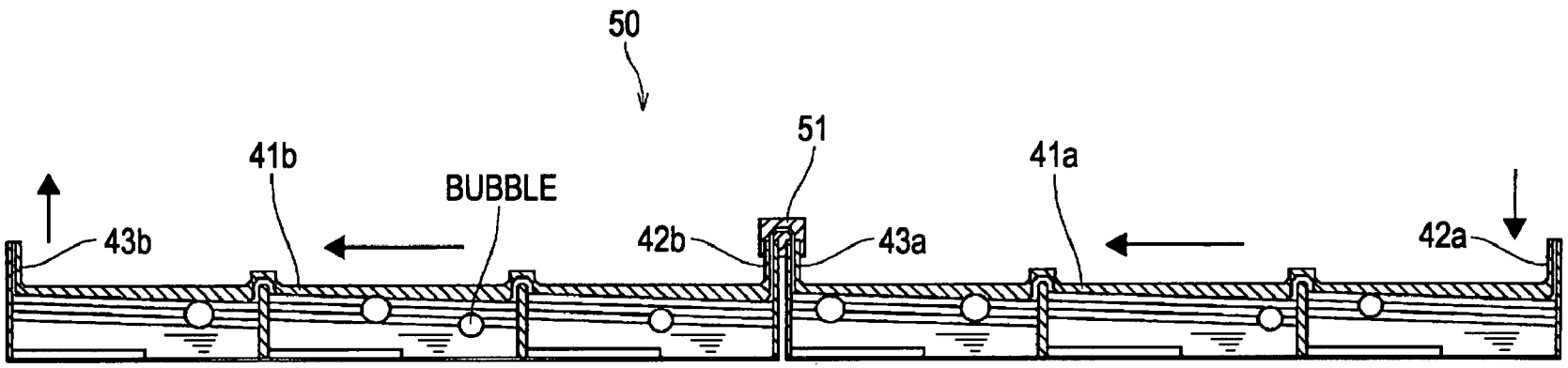
FIG. 8 is a cross-sectional view of a line head according to a fourth embodiment.

FIG. 8 is a cross-sectional view of a line head 50 according to a fourth embodiment of the present invention.

As shown in FIG. 8, two buffer tanks, which are similar to the buffer tank 41 shown in FIG. 7, are arranged in series in the line head 50. That is, two (N=2) buffer tanks, a buffer tank 41*a* having an inlet 42*a* and an outlet 43*a* and a buffer tank 41*b* having an inlet 42*b* and an outlet 43*b* are provided. The outlet 43*a* of the first ((N−1)-th) buffer tank 41*a* is connected to the inlet 42*b* of the second (N-th=second) buffer tank 41*b* by a connecting tube 51. Any number of buffer tanks may be arranged as long as the number is more than or equal to two.

When ink is supplied (circulated) from the inlet 42*a* of the first buffer tank 41*a*, a bubble in ink in the buffer tank 41*a* moves with the ink flow, and is ejected from the outlet 43*a*. The ink ejected from the outlet 43*a* and containing the bubble passes through the connecting tube 51, and enters the second (N-th=second) buffer tank 41*b* from the inlet 42*b*. The bubble in the ink is combined with a bubble originally existing in the buffer tank 41*b* into a larger bubble. The bubble is then ejected together with the ink from the outlet 42*b*.

Therefore, bubbles in the ink are ejected from both the buffer tanks 41*a* and 41*b*, and are removed at the subtank 12 (see FIG. 4). Since bubbles can be similarly removed regardless of how many buffer tanks 41 shown in FIG. 7 are connected, the line head 50 of the fourth embodiment shown in FIG. 8 is effective particularly for printing on a quite wide recording sheet 8 (see FIG. 8).

In the line printer 1 according to the embodiment (the line head 10 of the first embodiment, the line head 30 of the second embodiment, the line head 40 of the third embodiment, the line head 50 of the fourth embodiment), a plurality of grooves 25 (35*a* to 35*c*, 45*a* to 45*c*) are provided in the ceiling surface of the common passage 24 (34, 44) defined by the buffer tank 21 (31, 41). Therefore, bubbles in the ink smoothly move and can be easily removed from the common passage 24 (34, 44). This can prevent the bubbles in the ink from adversely affecting ink discharging.

By connecting the buffer tanks 21 (31, 41) including the grooves 25 (35*a* to 35*c*, 45*a* to 45*c*) in series, the line printer 1 can perform printing on larger recording sheets 8. Further, since the grooves 45*a* to 45*c* are inclined, a similar bubble removing effect can be obtained even when the line printer 1 is inclined, for example, because of the installation condition.

While the embodiments of the present invention has been described above, the present invention is not limited to the above embodiments. For example, the following various modifications can be made.

(1) While four grooves 25 are provided on each of the right and left sides of the ceiling surface of the common passage 24 so as to form steps in the line head 10 according to the first embodiment, the number and shape of the grooves 25 are not limited thereto. While the common passage 44 is divided into three passage chambers 44*a*, 44*b*, and 44*c* by the two partition walls 46*a* and 46*b* of the buffer tank 41 in the line head 30 according to the second embodiment, the number of partition walls is not limited thereto. Further, while the two (N=2) buffer tanks 41*a* and 41*b* are connected in series in the line head 50 according to the fourth embodiment, it is satisfactory as long as the number N of buffer tanks is more than or equal to two.

(2) While the inkjet line printer 1 in the embodiments includes the line head 10 having the length corresponding to the print width, the present invention is not limited to this printer, but is widely applied to other liquid discharging apparatuses for discharging various kinds of liquids. For example, the present invention is also applicable to a liquid discharging apparatus that discharges dye onto goods.

What is claimed is:

1. A liquid discharging head comprising:

a head chip including a plurality of energy generating elements configured to discharge liquid and liquid chambers provided around the corresponding energy generating elements; and a common passage member communicating with all the liquid chambers in the head chip, wherein the liquid is discharged from the liquid chambers by driving the energy generating elements so as to apply a discharging force to the liquid in the liquid chambers, wherein the common passage member includes an inlet through which the liquid is supplied to the common passage, and an outlet through which the liquid is ejected from the common passage, and wherein the common passage includes a ceiling surface having a groove extending from the inlet toward the outlet, and further wherein there are a plurality of grooves formed in a step structure above the ink ejecting members.

2. The liquid discharging head according to claim 1, wherein the groove of the common passage is inclined upward from the inlet toward the outlet.

3. The liquid discharging head'according to claim 1, wherein the common passage member includes a partition wall configured to divide the common passage into a plurality of passage chambers between the inlet and the outlet, and wherein the passage chambers communicate with each other on an upper side of the partition wall.

4. The liquid discharging head according to claim 1, wherein the common passage member includes N-number of common passage members, the value N is more than or equal to two, and the outlet of the (N−1)-th common passage member is connected to the inlet of the N-th common passage member.

5. The liquid discharging head according to claim 1, wherein the groove of the common passage is inclined upward from the inlet toward the outlet and there are two step structures extending up and away from opposed ink ejecting chips.

6. A liquid discharging apparatus comprising:

a head chip including a plurality of energy generating elements configured to discharge liquid, and liquid chambers provided around the corresponding energy generating elements;

a common passage member communicating with all the liquid chambers in the head chip; and transfer means configured to transfer the liquid, wherein the liquid is discharged from the liquid chambers by driving the energy generating elements so as to apply a discharging force to the liquid in the liquid chambers, wherein the common passage member includes an inlet through which the liquid is supplied to the common passage, and an outlet through which the liquid is ejected from the common passage, wherein the common passage includes a ceiling surface having a groove extending from the inlet toward the outlet, and further wherein there are a plurality of grooves formed in a step structure above the ink ejecting members and wherein the transfer means transfers the liquid from the inlet toward the outlet of the common passage member.

7. The liquid discharging apparatus according to claim 6, further comprising:

pressure adjustment means configured to adjust the pressure of the liquid to be supplied to the common passage, the pressure adjustment means being connected to the inlet of the common passage member.

8. The liquid discharging apparatus according to claim 6, further comprising:

pressure adjustment means configured to adjust the pressure of the liquid to be supplied to the common passage, the pressure adjustment means being provided between the transfer means and the inlet of the common passage member, wherein the transfer means is connected to the outlet of the common passage member, and wherein the liquid in the common passage is circulated via the pressure adjustment means by the transfer means.

9. The liquid discharging apparatus according to claim 6, wherein the groove of the common passage is inclined upward from the inlet toward the outlet and there are two step structures extending up and away from opposed ink ejecting chips.

10. A liquid discharging apparatus comprising:

a head chip including a plurality of energy generating elements configured to discharge liquid, and liquid chambers provided around the corresponding energy generating elements;

a common passage member communicating with all the liquid chambers in the head chip; and a transfer device configured to transfer the liquid, wherein the liquid is discharged from the liquid chambers by driving the energy generating elements so as to apply a discharging force to the liquid in the liquid chambers, wherein the common passage member includes an inlet through which the liquid is supplied to the common passage, and an outlet through which the liquid is ejected from the common passage, wherein the common passage includes a ceiling surface having a groove extending from the inlet toward the outlet, and further wherein there are a plurality of grooves formed in a step structure above the ink ejecting members and wherein the transfer device transfers the liquid from the inlet toward the outlet of the common passage member.

11. The liquid discharging apparatus according to claim 10, wherein the groove of the common passage is inclined upward from the inlet toward the outlet and there are two step structures extending up and away from opposed ink ejecting chips.

* * * * *